US007182672B2

(12) United States Patent
Tunaboylu et al.

(10) Patent No.: US 7,182,672 B2
(45) Date of Patent: Feb. 27, 2007

(54) METHOD OF PROBE TIP SHAPING AND CLEANING

(75) Inventors: Bahadir Tunaboylu, Gilbert, AZ (US); Jeff Hicklin, Gilbert, AZ (US); Ivan Pipps, Queen Creek, AZ (US); Son Dang, Tempe, AZ (US); Gerry Back, Gilbert, AZ (US)

(73) Assignee: SV Probe Pte. Ltd., Singapore (SG)

( * ) Notice: Subject to any disclaimer, the term of this patent is extended or adjusted under 35 U.S.C. 154(b) by 32 days.

(21) Appl. No.: 11/139,460

(22) Filed: May 27, 2005

(65) Prior Publication Data

US 2005/0260937 A1 Nov. 24, 2005

Related U.S. Application Data

(63) Continuation-in-part of application No. 09/921,327, filed on Aug. 2, 2001, now Pat. No. 6,908,364.

(51) Int. Cl.
*B25B 1/00* (2006.01)
*B24D 11/04* (2006.01)
*H01L 21/66* (2006.01)

(52) U.S. Cl. ..... 451/36; 451/41; 451/533

(58) Field of Classification Search ..... 451/28, 451/36, 57, 533, 537
See application file for complete search history.

(56) References Cited

U.S. PATENT DOCUMENTS 2,800,215 A * 7/1957 Converse ..... 400/702
3,148,404 A 9/1964 Jensen
5,152,695 A 10/1992 Grabbe et al.
5,173,055 A 12/1992 Grabbe
5,210,939 A 5/1993 Mallik et al.
5,223,741 A 6/1993 Bechtel et al.
5,604,330 A 2/1997 Hasan et al. ..... 174/52.4
5,644,249 A 7/1997 Kister
5,652,428 A 7/1997 Nishioka et al.
5,672,548 A 9/1997 Culnane et al.
5,778,485 A 7/1998 Sano et al.
5,814,158 A 9/1998 Hollander et al.
5,900,738 A 5/1999 Khandros et al. ..... 324/761

(Continued)

FOREIGN PATENT DOCUMENTS

EP 0937541 8/1999

(Continued)

*Primary Examiner*—David B. Thomas
(74) *Attorney, Agent, or Firm*—Hickman Palermo Truong & Becker LLP; Edward A. Becker

(57) ABSTRACT

Methods are provided for shaping, maintaining the shape of, and cleaning a probe tip using a pad such as a multi-layer adhesive and abrasive pad. The multi-layer adhesive and abrasive pad may be formed from layers of adhesive material having abrasive particles in-between each layer. Using the pad, probe tips may be shaped as desired from an unfinished probe stock, substantially limiting the use of relatively expensive conventional machining operations. Further, the pad may also be used to maintain probe tips in a desired operating shape. Still further, the pad may be used to clean accumulated debris from the probe tip. Preferably, the maintenance and cleaning operations are performed on-line, with the probes operatively installed in connection with testing machinery.

23 Claims, 7 Drawing Sheets

U.S. PATENT DOCUMENTS 5,917,707 A 6/1999 Khandros et al. ..... 361/776
5,923,090 A 7/1999 Fallon et al. ..... 257/777
5,934,914 A 8/1999 Fjelstad et al.
5,961,728 A 10/1999 Kiser et al.
5,968,282 A 10/1999 Yamasaka
5,994,152 A 11/1999 Khandros et al. ..... 436/617
5,998,986 A 12/1999 Ido
6,013,169 A 1/2000 Okubo et al.
6,019,663 A 2/2000 Angell et al.
6,023,103 A 2/2000 Chang et al. ..... 257/781
6,029,344 A 2/2000 Khandros et al. ..... 29/874
6,049,976 A 4/2000 Khandros ..... 29/843
6,050,829 A 4/2000 Eldridge et al. ..... 439/67
6,056,627 A 5/2000 Mizuta
6,124,546 A 9/2000 Hayward et al. ..... 174/52.2
6,130,104 A 10/2000 Yamasaka
6,168,974 B1 1/2001 Chang et al. ..... 438/109
6,170,116 B1 1/2001 Mizuta
6,183,677 B1 2/2001 Usui et al.
6,184,053 B1 2/2001 Eldridge et al. ..... 438/52
6,184,587 B1 2/2001 Khandros et al. ..... 257/784
6,215,196 B1 4/2001 Eldridge et al. ..... 257/784
6,215,670 B1 4/2001 Khandros ..... 361/774
6,232,149 B1 5/2001 Dozier, II et al. ..... 438/117
6,242,803 B1 6/2001 Khandros et al. ..... 257/750
6,268,015 B1 7/2001 Mathieu et al. ..... 427/96
6,280,529 B1 8/2001 Meyer
6,306,187 B1 10/2001 Maeda et al.
6,330,164 B1 12/2001 Khandros et al. ..... 361/760
6,354,868 B1 3/2002 Korczynski et al.
6,420,887 B1 7/2002 Kister et al.
6,441,315 B1 8/2002 Eldridge et al. ..... 174/260
6,475,822 B2 11/2002 Eldridge et al. ..... 438/526
6,476,333 B1 11/2002 Khandros et al. ..... 174/267
6,482,013 B2 11/2002 Eldridge et al. ..... 439/66
6,483,328 B1 11/2002 Eldridge et al. ..... 324/754
6,491,968 B1 12/2002 Mathieu et al. ..... 427/96
6,492,827 B1 * 12/2002 Mazur et al. ..... 324/761
6,497,581 B2 12/2002 Slocum et al.
6,520,778 B1 2/2003 Eldridge et al. ..... 439/66
6,532,654 B2 3/2003 Guerin et al.
6,538,214 B2 3/2003 Khandros ..... 174/267
6,539,531 B2 3/2003 Miller et al. ..... 716/15
6,777,966 B1 8/2004 Humphrey et al.
6,840,374 B2 * 1/2005 Khandros et al. ..... 206/223
2001/0002341 A1 5/2001 Eldridge et al. ..... 439/66
2001/0038030 A1 11/2001 Khandros et al. ..... 228/155
2002/0117330 A1 8/2002 Eldridge et al. ..... 174/260
2002/0145032 A1 10/2002 Khandros et al. ..... 228/155
2003/0010976 A1 1/2003 Grube et al. ..... 257/48
2003/0015347 A1 1/2003 Eldridge et al. ..... 174/260
2003/0027496 A1 2/2003 Back et al.
2003/0057975 A1 3/2003 Eslamy et al. ..... 324/754
2003/0062398 A1 4/2003 Khandros ..... 228/112.1
2005/0001645 A1 * 1/2005 Humphrey et al. ..... 324/757
2005/0255796 A1 * 11/2005 Haga ..... 451/41

FOREIGN PATENT DOCUMENTS

JP 07244074 A 9/1995
JP 10019928 A 1/1998

* cited by examiner

METHOD OF PROBE TIP SHAPING AND CLEANING

CROSS-REFERENCE TO RELATED APPLICATIONS

The present application is a continuation-in-part of application Ser. No. 09/921,327 "METHOD AND APPARATUS FOR PROBE TIP CLEANING AND SHAPING PAD" filed Aug. 2, 2001 now U.S. Pat. No. 6,908,364, the entire disclosure of which is incorporated herein by reference. The present application claims priority from the Ser. No. 09/921,327 application.

FIELD OF THE INVENTION

The present invention relates to test equipment used in semiconductor manufacturing, and more particularly to the fabrication and maintenance of test probes.

BACKGROUND OF THE INVENTION

In semiconductor integrated circuit manufacturing, it is conventional to test the integrated circuits ("IC's") during manufacturing and prior to shipment to ensure proper operation. Wafer testing is a well-known testing technique commonly used in production testing of wafer-mounted semiconductor IC's (or "dice"), wherein a temporary electrical current is established between automatic test equipment (ATE) and each IC (or die) on the wafer to demonstrate proper performance of the IC's. Components often used in wafer testing include an ATE test board, which is a multi-layer printed circuit board that is connected to the ATE, and that transfers the test signals back and forth between the ATE and a probe card.

With reference to FIG. 1, a conventional probe card (aka a probe card assembly) includes a printed circuit board (PCB) (not illustrated) having contacts in electrical communication with several hundred probes/probe elements or needles 10 positioned to establish electrical contact between a tip portion 12 of each of the probes 10 and a series of connection terminals (or "die contacts" or "electrodes" or "pads" or "electrode pads") 20 on the IC wafer (or "semiconductor device") 30. Known probe cards further include a substrate 40 (e.g., a space transformer 40) which electrically connects the probes to the printed circuit board. The substrate 40 may include, for example, a multi-layer ceramic substrate, or a multi-layer organic substrate. It is known to mount each of the plurality of flexible probes 10 to a mounting surface of the substrate 40. Typically, the probes 10 are mounted to electrically conductive, preferably metallic bonding pads formed on the substrate 40 through conventional plating or etching techniques well known to those of ordinary skill in the art of semiconductor fabrication. Alternatively, it is known to mount the probes 10 within a probe head assembly which positions ends of the probes in electrical communication with contacts on the substrate/space transformer surface.

Semiconductor geometry is constantly decreasing. For example, electrodes 20 may be 50 micrometers by 50 micrometers in size and the on-center distance between the electrodes 20, otherwise known as the pitch, may be approximately 75 micrometers. In order to contact only one electrode 20 at a time, a probe needle 10 of a small diameter is desired. The probe 10 should be large enough in diameter to provide the mechanical stability and support necessary to keep the probe needle 10 from bending excessively. However, because of the small size of the electrodes 20, it is desirable that the probe tips be pointed or needle-like. Probes 10 may be made of many different materials, as is known in the art, and in one embodiment may be made of tungsten. Other materials used for probes 10 include nickel alloys, paliney, beryllium copper, tungsten-rhenium, palladium alloys, and silicon in combination with a metal coating.

With continued reference to FIG. 1, electrode 20 of semiconductor device 30 may be formed of aluminum (Al) or other metallic materials known in the art, such as aluminum-silicon-copper pads, gold pads, and lead/tin bumps. An aluminum oxide layer, or other oxide layer, may form over the surface of electrode 20 during the wafer manufacturing process. Because aluminum oxide is an insulator, if present, it is desirable to scratch through the oxide layer so that a reliable contact is formed between the electrode 20 and the probe tip 12. Scratching through the oxide layer may be accomplished by an "overdrive" process. The probe tip 12 is brought in to contact with the wafer electrode 20, and then "overdriven" an additional amount, moving the probe 10 closer to the electrode 20, and increasing the contact force between the probe tip 12 and the electrode 20. The overdrive process may also include relative lateral movement between the probe 10 and the wafer 30, allowing the probe tip 12 to more readily scrape the surface of the electrode, and to breach any oxide layer.

The overdrive process may break through the oxide layer to make a good electrical connection with the electrode; however, extraneous particles such as aluminum, aluminum oxide, silicon, and other types of particles, debris or foreign matter may adhere to the surface of the probe tip 12. After repeated probing operation, the particles on the probe tip 12 may prevent a good conductive connection from forming with electrode 20 and the probe tip 12. The repeated probing process may also cause the probe tip 12 to become blunted. A blunt probe tip may make the probe tip 12 less effective at scratching the surface of the electrode 20. A blunted probe tip may also cause probe marks to go beyond the specified allowable electrode contact area on the wafer if the blunt end of the tip becomes too large. A pointed probe tip has a smaller tip surface area at the end of the probe tip such that, for the same force, a higher pressure can be applied on the aluminum oxide, providing for an enhanced ability to break through the aluminum oxide.

A further problem related to the blunting of a probe tip 12 is that uneven blunting of probe tips creates probes of different lengths leading to planarity problems. Probes 12 may wear unevenly because sometimes some of the probes may be probing portions of the wafer where no electrodes exist and the probes touch down on materials of different hardness than the electrode pad 20. Additionally, probe tips 12 may have burrs formed when the probes were made or sharpened, or from adhered debris. Probes 10 may also be uneven in length for other reasons. Regardless of the reason for the variability in the probe tip lengths, planarity problems decrease the ability of the probes to properly contact the target electrode pads. Some efforts to improve planarity involve the blunting of non-blunted probe tips to conform to the length of the already blunted tips. This, however, negatively impacts the performance of the probe cards in other respects as discussed herein.

In response to the problem of particles adhering to the probe needle 10, a number of techniques have been developed for cleaning probe tips 12. For example, U.S. Pat. No. 6,170,116 (i.e., the '116 patent) discloses an abrasive sheet which is composed of a silicon rubber which provides a matrix for abrasive particles, such as an artificial diamond powder. The '116 patent discloses that upon insertion of a probe into the abrasive sheet some of the extraneous particles that adhere to the probe tip may be removed or scraped off by the abrasive particles. Unfortunately, this process may not remove all of the extraneous particles from the probe tip and may contaminate the probe tip with a viscous silicon rubber film or other particles which adhere to the tip as it is stuck into the silicon rubber matrix. To counteract this secondary particle contamination of the tip, the probe needle may be cleaned by spraying an organic solvent onto the tip of the needle, thereby dissolving and removing some of the viscous silicon rubber film and perhaps some of the secondary particles. Thereafter, the organic solvent may be blown off the probe tip in order to further prepare the tip. This process is time consuming and is performed off-line. Furthermore, the process may result in particles stuck to the tip and even introduce further contaminates.

Other wafer cleaning devices are disclosed. A cleaning wafer with a mounted abrasive ceramic cleaning block, which is rubbed against the probe needles, is disclosed in U.S. Pat. No. 6,019,663. The use of a sputtering method to remove particles from the probe tip is disclosed in U.S. Pat. No. 5,998,986. The use of a rubber matrix with abrasive particles and a brush cleaner made of glass fibers is disclosed in U.S. Pat. No. 5,968,282. Use of lateral vibrational movement against a cleaning surface for removing particles from a probe tip is disclosed in U.S. Pat. No. 5,961,728. Spraying or dipping the probe needles in cleaning solution is disclosed in U.S. Pat. No. 5,814,158. Various other cleaning methods are disclosed in U.S. Pat. Nos. 5,778,485 and 5,652,428.

Many of these methods and devices interrupt the testing of wafers by use of off-line processing to clean the probe tips. Some of these methods introduce further contaminates to the probe tips. Some of these methods exacerbate the blunting of the probe tips. None of these methods adequately address the shaping of probe tips while cleaning on-line. Probe tip shaping extends the life of the probe needle, and enhances the scratching ability, thereby enhancing the reliability of the electrical contact.

Therefore, it would be desirable to provide an on-line method and apparatus to clean particles from probe tips without the use of solvents or blowing mechanisms. Furthermore, it would be desirable to provide a method and apparatus for cleaning probe tips that does not blunt the tip of the probes, but rather enhances the shape of the probe tip. Additionally, it would be desirable to provide the ability to clean and shape the probe tips in a quick and consistent manner with minimal downtime.

SUMMARY OF THE INVENTION

According to an exemplary embodiment of the present invention, a method of shaping a tip portion of a probe element configured for use in a probe card assembly is provided. The method includes providing a probe element having a tip portion, and providing a pad including an abrasive material and an adhesive material. The method also includes inserting the tip portion into the pad to a predetermined depth and removing the tip portion from the pad. The insertion and removal process is performed for a predetermined number of cycles.

According to another exemplary embodiment of the present invention, a method of maintaining a desired shape of a tip portion of a probe element configured for use in a probe card assembly is provided. The method includes providing a probe element having a tip portion worn from usage to a non-desired shape, and providing a pad including an abrasive material and an adhesive material. The method also includes inserting the tip portion into the pad to a predetermined depth and removing the tip portion from the pad. The insertion and removal process is performed for a predetermined number of cycles.

According to yet another exemplary embodiment of the present invention, a method of cleaning a tip portion of a probe element configured for use in a probe card assembly is provided. The method includes providing a probe element having a tip portion and providing a multi-layered adhesive and abrasive particle pad. The method also includes inserting the tip portion into the pad to a predetermined depth and removing the tip portion from the pad. The insertion and removal process is performed for a predetermined number of cycles.

According to certain exemplary embodiments of the present invention, both the method of maintaining the desired shape and the method of cleaning the tip portion are performed with the probe element integrated with a semiconductor testing apparatus. For example, the probe element (e.g., an array of probe elements) is provided as part of a probe card assembly providing electrical interconnection between a semiconductor device to be tested (e.g., a non-singulated wafer of dies) and a testing system for testing the device.

BRIEF DESCRIPTION OF THE DRAWINGS

For the purpose of illustrating the invention, there is shown in the drawings forms that are presently preferred; it being understood, however, that this invention is not limited to the precise arrangements and constructions particularly shown.

DETAILED DESCRIPTION OF THE DRAWINGS

Figure 1:
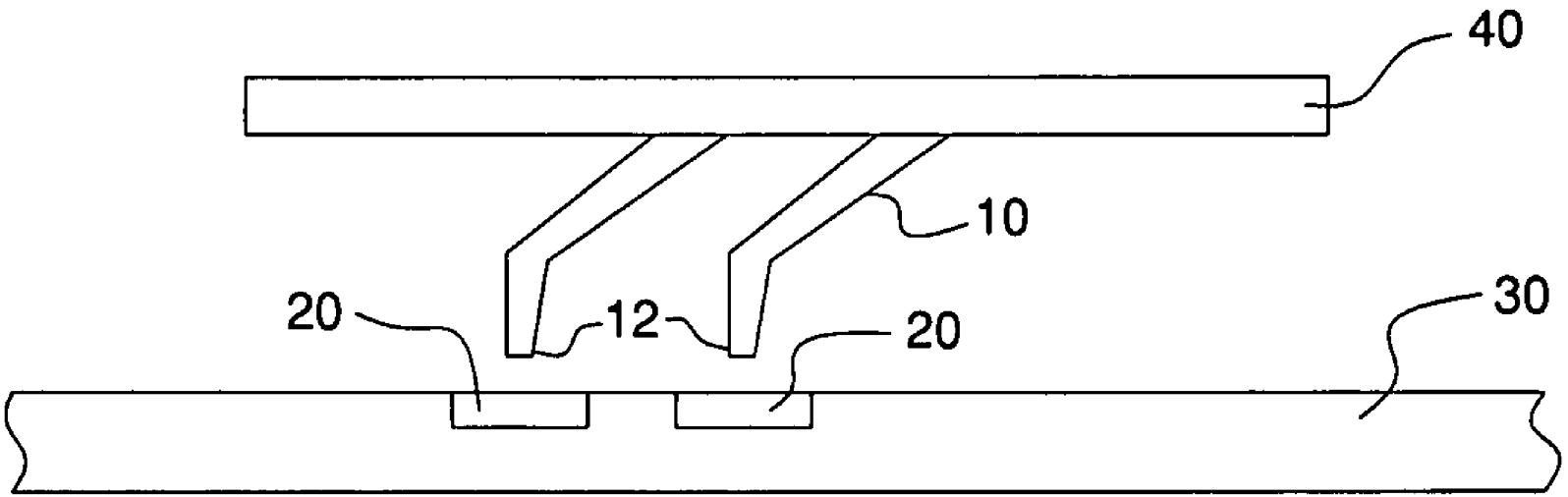
FIG. 1 ( Prior Art )
FIG. 1 is a side elevation view of elements of a conventional probe card and a semiconductor wafer positioned for testing.

As used herein, the term "pad" is intended to refer to any structure including an abrasive material (e.g., abrasive particles) and adhesive material which is configured to (1) shape a tip portion of a probe element, (2) maintain a desired shape of a tip portion of a probe element, and/or (3) clean a tip portion of a probe element. As such, the term "pad" is not intended to be limited to any specific shape, material, or configuration. Further, the term "multi-layered adhesive and abrasive particle pad" is intended to refer a specific category of "pads" that include a plurality of layers, where certain of the layers include abrasive material and/or adhesive material. Examples of such a "multi-layered adhesive and abrasive particle pad" are described herein and in pending U.S. patent application Ser. No. 09/921,327.

Referring now to the drawings wherein like reference numerals identify like elements, the present invention may be described herein in terms of various hardware components and processing steps. It should be appreciated that such components may be realized by any number of hardware components configured to perform the specified functions. For example, the present invention may employ various integrated circuit components, e.g., transistors, memory elements, digital signal processing elements, integrators, motors, actuators, servos, gears, and the like, which may carry out a variety of functions under the control of one or more microprocessors or other control devices. Moreover, various types of material may be used in making the probe tip cleaning and shaping pads. In addition, those skilled in the art will appreciate that the present invention may be practiced in any number of probing device contexts and that the preferred embodiment described herein is merely one exemplary application for the invention. General techniques that are known to those skilled in the art are not described in detail herein.

Figure 2:
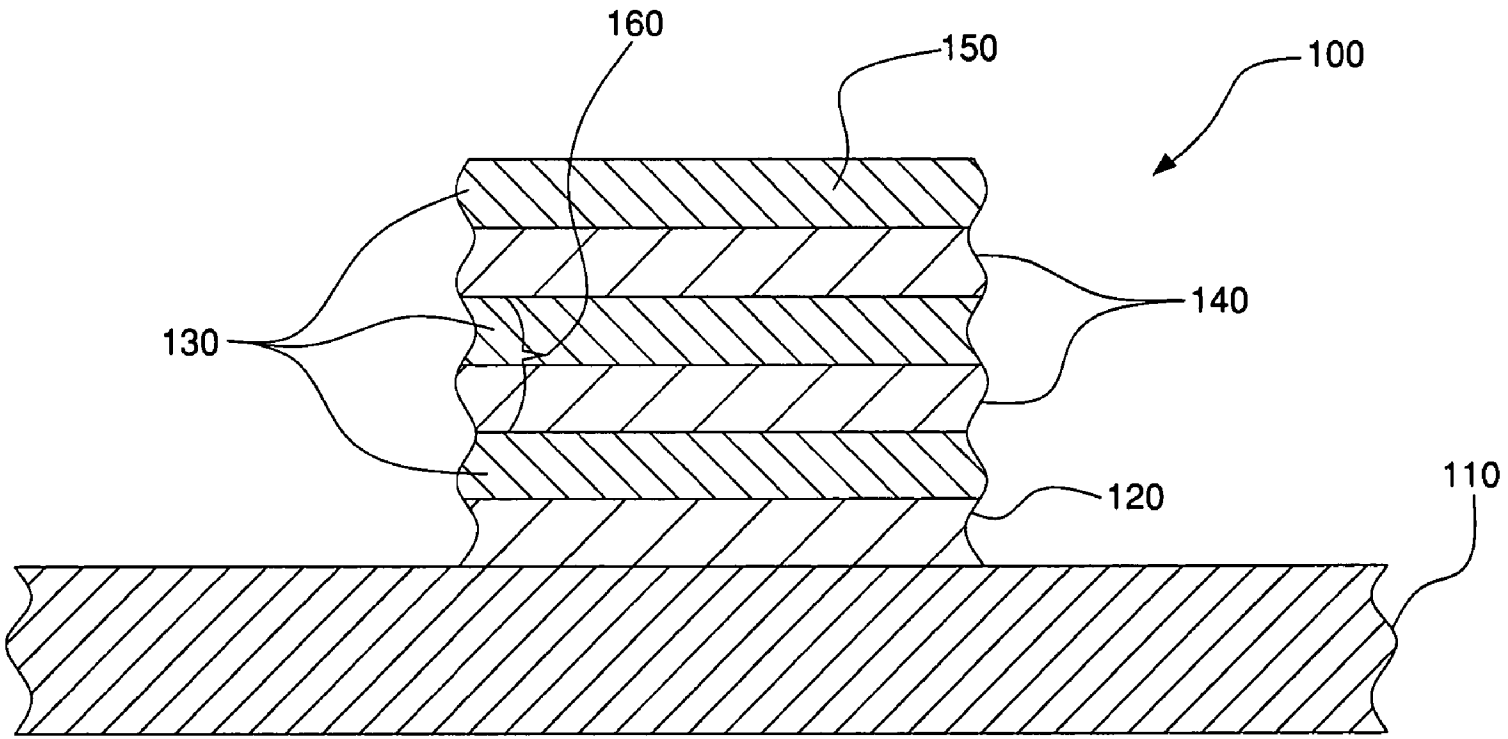
FIG. 2 is a side elevation view of a multi-layer adhesive and abrasive pad and pad support structure in accordance with an exemplary embodiment of the present invention.

An exemplary multilayer adhesive and abrasive pad ("MAAP") 100 for cleaning and shaping probe tips is illustrated in FIG. 2 according to various aspects of the present invention. A support structure 110 supports the MAAP 100. MAAP 100 is attached to support structure 110 by, for example, a first adhesive layer 120. MAAP 100 is made of abrasive particles and adhesive material. MAAP 100 has first adhesive layer 120 and successive layers of abrasive particles 130 and adhesive 140. Top layer 150 is preferably an abrasive layer 130.

In one embodiment, the support structure 110 is a semiconductor wafer which supports the probe tip cleaning and shaping pad or MAAP 100. A silicon wafer may be a convenient choice of support structure because it is easily adaptable for use in the machines which test the semiconductor wafers 30. For example, with a silicon wafer support structure 110, it is possible to test one or more semiconductor wafers 30, or even to test a portion of a semiconductor wafer 30, and then remove the tested wafer and replace it with a MAAP 100, including a semiconductor wafer supporting pad 110, for on-line cleaning and shaping of the probe tips. Alternatively, other support structures may be used such as, for example, flat disks made of stainless steels or ceramics or glass. Support structure 110 may have a thickness of 500 micrometers in one embodiment, and in other embodiments may be thinner or thicker as necessary to provide the desired stiffness characteristics (in view of the support structure material stiffness properties). The support structure is preferably substantially flat in order to minimize planarity problems.

First adhesive layer 120 is attached to one surface of support structure 110. In accordance with one aspect of the present invention, first adhesive layer 120 may comprise a double-sided adhesive tape to aid in the simple removal and replacement of MAAP 100. For example, when MAAP 100 needs replacing or is no longer needed, it can be peeled off of support structure 110. In other embodiments, a more permanent connection may be provided by using single or multiple layers of adhesive for first adhesive layer 120 instead of the double-sided tape. Other layers of adhesive 140 may exist between successive layers of abrasive particles 130. Two or more layers of adhesive may make up first adhesive layer 120, and a single layer of adhesive may exist in the inter-layers. Hence, any number of layers may be applied to form the first adhesive layer 120 or to form adhesive layers 140 between abrasive particle layers 130.

In one embodiment, the adhesive material may be an acrylic adhesive such as 3M F-9160PC available from 3M. Alternatively, the adhesive material may be made of elastic, TEFLON® material, polymer, epoxy, polyurethane or other materials exhibiting soft, pliable properties that are available or formable in thin sheet form. These products may be available through any number of suppliers, such as 3M, Epoxy Technology, and Dexter. The thin layer of adhesive material may, for example, be approximately 50 micrometers in thickness, although thinner and thicker layers may be used.

In one embodiment, adhesive layer 140 may provide the minimum adhesive sufficient to hold the next layer of abrasive particles. Use of an adhesive, such as an acrylic adhesive, in multi-layer adhesive and abrasive pad 100 provides several advantages over a composite resin matrix suspending abrasive particles in a resin material. Top layer 150 of MAAP 100 may include abrasive particles which may make the adhesive material less likely to stick to the probe tip than the resin material in matrix type cleaning pads. MAAP 100 further may not require the extra cleaning steps often used in resin matrix devices. Also, adhesive, in many cases, tends to be softer than resin which allows the insertion of probe tips 150 into MAAP 100 under less pressure than that typically required for resin pads, thus reducing the chances of bending (and potentially over-stressing) the probes. Furthermore, the probe needles 10 are less likely to get stuck in MAAP 100 than in resin pads which have been known to yank probes out of the head of the probe card. MAAP 100 has the further advantage of facilitating the piercing of the pad with the probe needles 10 because the adhesive may not be as hard as resin pads. The adhesive in MAAP 100 also has a relatively short recovery time (compared to resin materials) allowing holes in the adhesive to reseal which may facilitate the cleaning of the probe tips, the capture of particles within the pad, and allow the reuse of areas of MAAP 100.

Abrasive layers 130 may be located between adhesive layers 120 and 140. Abrasive layers 130 may include top abrasive layer 150. The abrasive material in one embodiment may include diamond particles; for example, 15 micron and 16 micron SUN E8 diamond powder manufactured by Sun Marketing Group. Alternatively, other materials, such as, for example, aluminum oxide, zirconia, alumina-zirconia mixtures, tungsten carbide, silicon carbide, silicon nitride, and titanium carbide, may suitably be used for one or more of the abrasive particle layers. Furthermore, any material with a hardness higher than those of the probe materials might be used as abrasive particles in MAAP 100. For example, the abrasive particles might have a hardness that is harder than a Vickers hardness of approximately 1000 $kg/mm^2$.

Because different probes have different hardness values, the hardness of the abrasive materials used in different layers of MAAP 100 may vary between pads designed for probes made of different materials. As an example of probe hardness, tungsten rhenium is one of the hardest probes with a Hardness Value ("HV") of 650 $kg/mm^2$, paliney is in the range of 350–100 $kg/mm^2$, and beryllium-copper or nickel alloy are in the range of 300–350 $kg/mm^2$.

As an example of foreign particle hardness, aluminum oxide has a HV of 1500 $kg/mm^2$, and copper oxide (cupric oxide) is much softer than aluminum oxide. As an example of abrasive particle hardness, diamond has a HV of 10,000 $kg/mm^2$, and silicon carbide is 2500–3500 $kg/mm^2$. Abrasive particles might also be selected or created to have other qualities such as high compressive and fracture strength. Abrasive particles might also be selected or created such that the abrasive particles are harder than the foreign particles and debris being removed from the probe tips. For example, diamond abrasive particles may be used to remove aluminum oxide. Abrasive particles might also be chosen based on their hardness and particle size and particle size distribution in removal of debris.

In accordance with another aspect of the present invention, the grit sizes of the abrasive material in inter-layers 130 and on surface layer 150 may be well defined. For example, all of the abrasive particle layers 130 and 150 may be selected to have the same grit size. Alternatively, the grit sizes and materials may vary from one layer to the next, such as where the largest grit is in surface layer 150 and the grit size is smaller in each successive layer 130 closer to support structure 110. In this example, the coarser grit material may provide better bulk shaping and cleaning, and the finer size grit may provide finer shaping, cleaning and polishing of the ends of the tip. Therefore, the finer grit may be placed in MAAP 100 so as to contact a specific portion of the probe nearest the tip. Polishing the probe tip makes it less likely that foreign particles will stick to the probe tip. Grit sizes and materials may be selected in reverse graduated order with the smallest grit on top layer 150 and larger grits as the layers get closer to support structure 110. The individual grit sizes in each layer may also be varied to achieve other shaping needs.

In a further example, the size of the grit of the abrasive material may be chosen based on the types of materials used in the probe tips. Exemplary probe tip materials include nickel alloys, paliney, beryllium-copper, tungsten, and other materials well known in the art of wafer testing. For example, tungsten rhenium probe tips are very strong and may require a coarser grit to achieve tip shaping in an efficient manner. In contrast, smaller grit sizes may be used for probe tips made of softer materials such as paliney, beryllium-copper, and nickel. Also, the grit sizes may be chosen with regard to the strength of the probe needles so as not to bend the needles as they are inserted into pad 100. In another embodiment, grit sizes and materials may be chosen based upon their ability to remove specific types of foreign matter, debris and particulates that are likely to adhere to the probe tips. Furthermore, in an exemplary embodiment, desired probe tip radius sizes may be a determining factor in choosing abrasive particle grit size. For example, larger grit sizes may result in a larger tip radius, and smaller grit sizes may result in a smaller tip radius.

The abrasive inter-layers may contain various types, sizes and quantities of abrasive material, and types and quantities of adhesive material. Also, the layers may vary in thickness, for example, from 25 microns to 100 microns. In one embodiment, a stack of six layers of abrasive and adhesive material may be used for an exemplary MAAP 100 to provide a total height of 25 mils (635 microns). In other embodiments, more or fewer layers of adhesive and abrasive may be used, and the total height of pad 100 may be selected such that it is thick enough for the insertion of a sufficient portion of the probe tip, for example, 10mils, such that probe tip 12 can be cleaned and shaped without contacting the support structure. While any number of layers may be chosen with varying thickness choices, the total thickness of pad 100 should be such that the probe tip may be inserted to a desired depth without the probe tip coming into contact with the support structure 110. For example, the thickness of the pad may range from 2 mils to 200 mils, and the number of abrasive layers may range from 1 to 100. In one embodiment, 6 layers of abrasive alternate with 6 layers of adhesive forming a 25 mils pad with an adhesive layer between each abrasive layer. In another embodiment, specific abrasive material and sizes may be used for shaping specific parts of probe tip 12. In this embodiment, it may be desirable to coordinate the vertical location of specific abrasive material layers with the penetration depth of probe tip 12.

An exemplary embodiment of a MAAP 100 may be constructed in the following manner. A silicon wafer support structure 110 is set on a hot chuck which is heated to approximately 120 degrees F. A first adhesive layer 120 is applied to the surface of support structure 110. Adhesive layers 120 and 140 may be formed on support structure 110 or on abrasive layers 130 by using an adhesive attached to an applicator or "backing" layer. Layers of adhesive may be applied to the abrasive layer 130 or support structure 110 by pressing the adhesive holding backing layer onto the abrasive layer 130 or support structure 110 with the adhesive side of the backing facing toward the support structure 110. This may be done while heating the support structure and layers on the support structure. A roller or other device may be used to eliminate any air bubbles and to improve the planarity of the adhesive layer. Alternatively, the adhesive and backing can be rolled or otherwise applied directly on to support structure 110 or abrasive layer 130. The backing material can then be peeled off exposing the thin layer of adhesive material. Alternatively, the adhesive material may be applied by any other known method, such as spraying or applying to a spinning wafer.

An abrasive layer 130 may be added by pouring or sprinkling the abrasive particles over the adhesive and optionally assisting the attachment of the particles to the adhesive by use of a brush or other tool. The remainder of the abrasive material that does not stick to the adhesive may be dumped, blown, or brushed away to prepare the MAAP for another layer of adhesive. Any other method of applying the abrasive particles to the adhesive may be used.

In one embodiment, each layer of adhesive 140 and of abrasive 130 can be treated as separate layers because they may be applied as such. However, some intermixing of adhesive and abrasive occurs as the abrasive sticks to the adhesive. Therefore, in another embodiment, adjacent abrasive and adhesive layers may be considered a composite layer 160. As discussed above, pad 100 may be made such that one composite layer 160 has a different abrasive particle grit size or material from another composite layer 160.

In use, the MAAP 100 may be used in conjunction with any type of probe 10, including both vertical probes and cantilever probes. In one particular type of use, a method of fabricating/shaping a tip of a probe element used in a probe card comprises a step of providing a probe element 10 having an unfinished tip portion 12 and a multi-layered adhesive and abrasive particle pad 100. The probe tip 12 is repeatedly inserted into the pad 100 to a predetermined or desired depth and removed from the pad 100. The insertion and removal process is repeated for a predetermined number of cycles or until such time as a desired degree of cleaning or shaping is achieved. Each cycle of insertion and removal is a "touchdown." Preferably, the predetermined depth is in the range of about 0.010 inches to about 0.012 inches.

The method of fabricating the probe tip may further comprise a step of indexing the probe tip 12 relative to the pad 100 by a predetermined distance between each touchdown cycle. The predetermined distance is preferably about 0.003 inches. Preferably, the touchdowns are performed at a rate less than about 5 cycles per second (and preferably on the order of about 10,000 cycles per hour). The MAAP 100 is preferably sized and configured to accommodate on the order of 50,000 total touchdowns before it is discarded.

Figure 5:
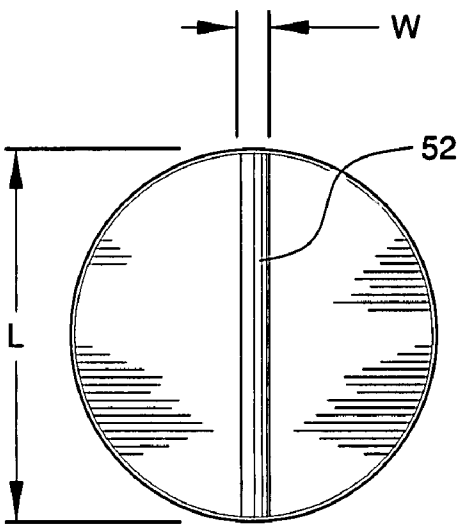
FIG. 5 (Prior Art)
FIG. 5 is a top plan view of a vertex portion of the conventional wedge tip probe of FIG. 3.
Figure 4:
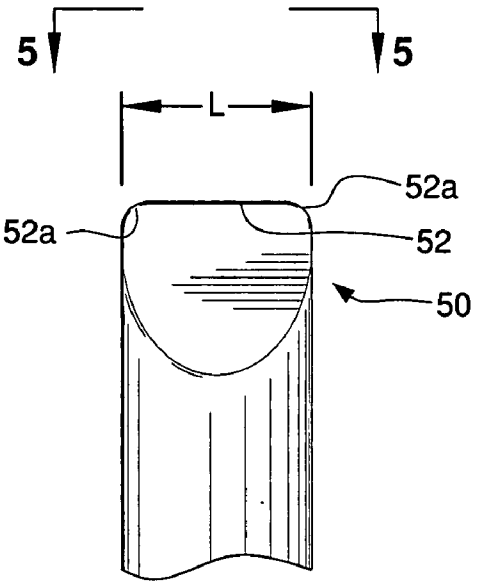
FIG. 4 (Prior Art)
FIG. 4 is a side elevation view of the conventional wedge tip probe of FIG. 3.
Figure 3:
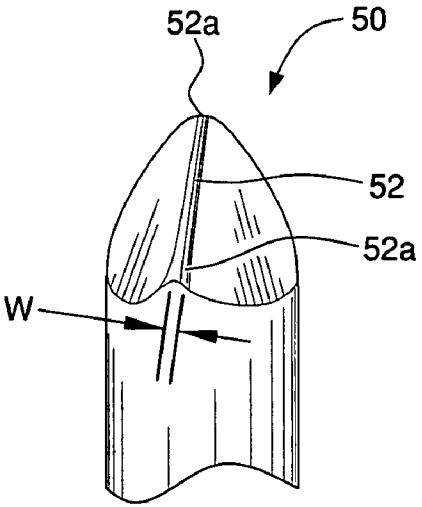
FIG. 3 (Prior Art)
FIG. 3 is a perspective view of a conventional wedge tip probe.

With reference now to FIGS. 3–5, a conventional wedge probe 50 is shown with a tip portion forming a tip apex 52. The tip apex 52 has opposing ends 52*a*. The apex 52 is the portion of the wedge probe 50 adapted to contact the electrodes 20. The apex 52 is characterized by a width W and a length L. One difficulty encountered with use of a conventional wedge probe 50 is that debris tends to accumulate at the relatively sharp ends 52*a*. According to certain exemplary embodiments of the present invention, it is desirable, therefore, to radius the ends 52*a*.

Figure 8:
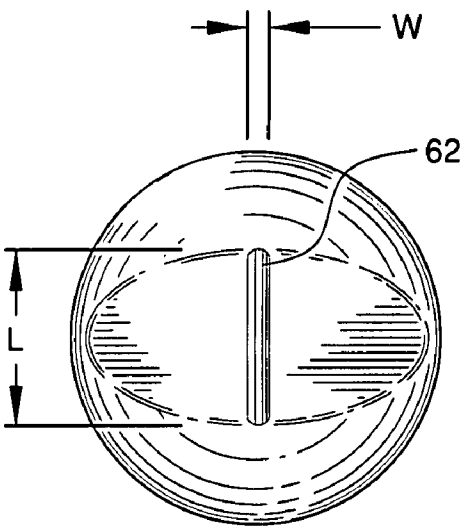
FIG. 8 is a top plan view of a vertex portion of the shaped probe of FIG. 6.
Figure 7:
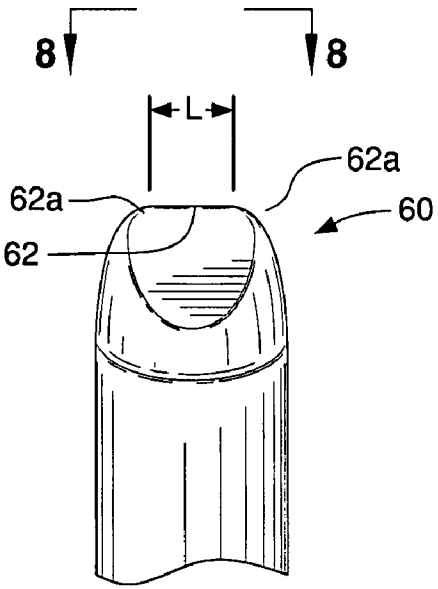
FIG. 7 is a side elevation view of the shaped probe of FIG. 6.
Figure 6:
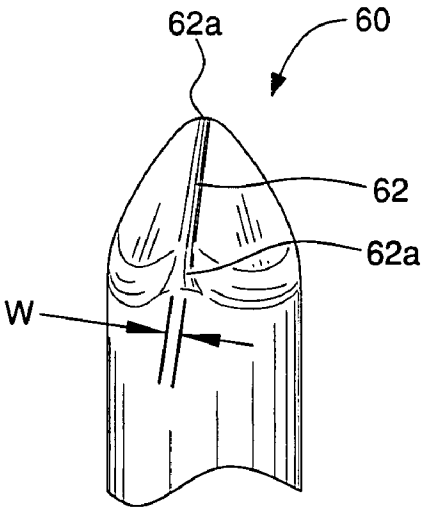
FIG. 6 is a perspective view of a conventional wedge tip probe having a tip portion shaped in accordance with an exemplary embodiment of the present invention.
Figure 9:
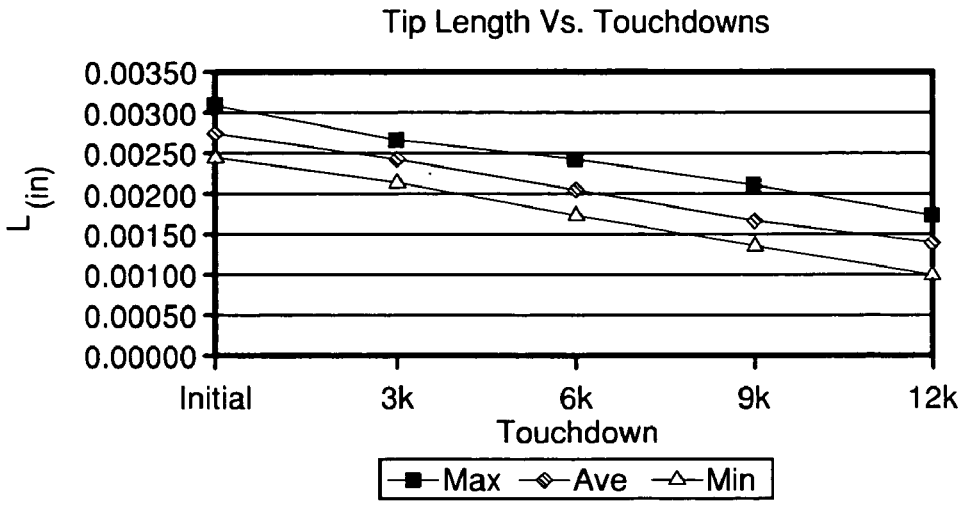
FIG. 9 is a graphical plot of test data showing variation of the length of the vertex portion of a wedge tip probe as a function of number of "touchdowns" (cycles of probe tip insertion into and withdrawal from the multi-layer adhesive and abrasive pad) in accordance with an exemplary embodiment of the present invention.
Figure 10:
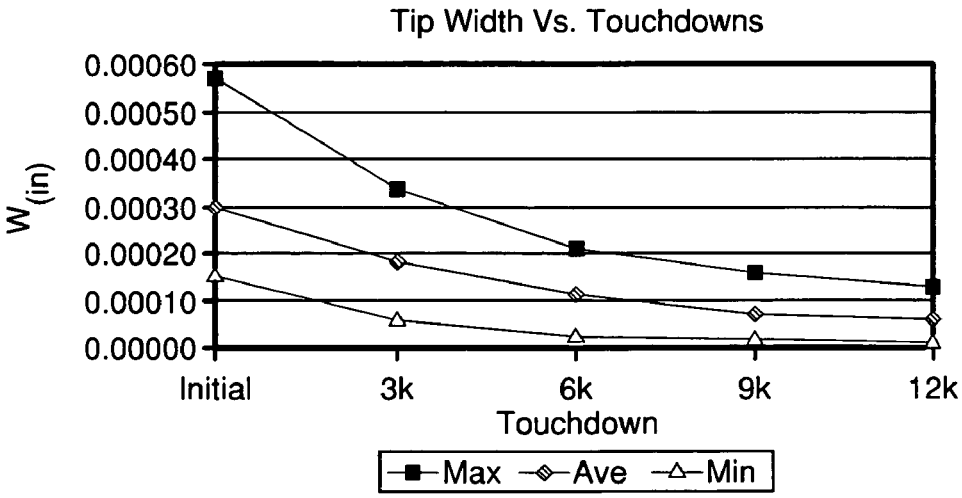
FIG. 10 is a graphical plot of test data showing variation of the width of the vertex portion of a wedge tip probe as a function of the number of touchdowns in accordance with an exemplary embodiment of the present invention.
Figure 11:
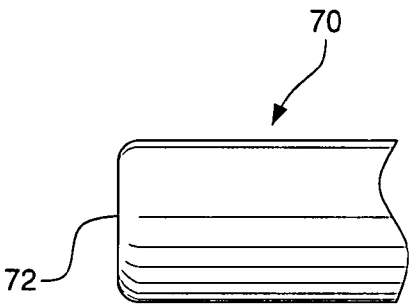
FIG. 11 is a side view of an unfinished tip of a flat probe element having a squared-off, blunt tip.
Figure 12:
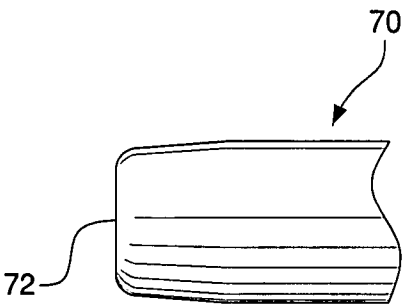
FIG. 12 is a side view of the probe element of FIG. 11, shown after undergoing 5,000 touchdown cycles in a multilayer adhesive and abrasive pad having abrasive particles with an average size of about 25 microns in accordance with an exemplary embodiment of the present invention.
Figure 13:
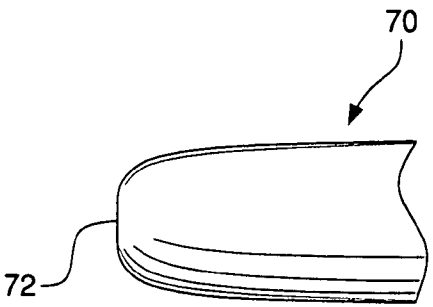
FIG. 13 is a side view of the probe element of FIG. 11, shown after undergoing 10,000 touchdown cycles in the multi-layer adhesive and abrasive pad having abrasive particles with an average size of about 45 microns in accordance with an exemplary embodiment of the present invention.
Figure 14:
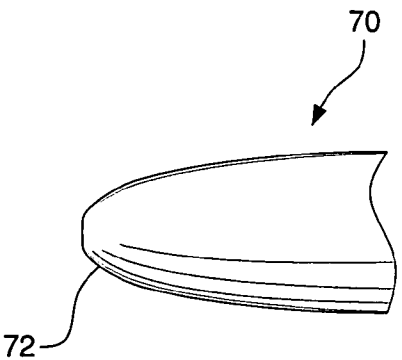
FIG. 14 is a side view of the probe element of FIG. 11, shown after undergoing 15,000 touchdown cycles in the multi-layer adhesive and abrasive pad having abrasive particles with an average size of about 25 microns in accordance with an exemplary embodiment of the present invention.
Figure 15:
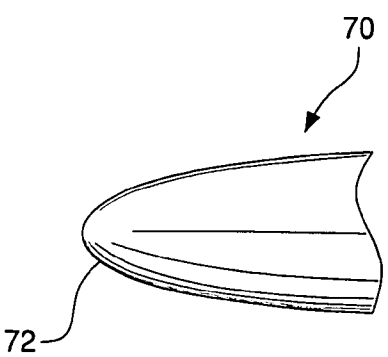
FIG. 15 is a side view of the probe element of FIG. 11, shown after undergoing 20,000 touchdown cycles in the multi-layer adhesive and abrasive pad having abrasive particles with an average size of about 25 microns in accordance with an exemplary embodiment of the present invention.

With reference now to FIGS. 6–8, the conventional wedge probe may be subjected to the method of fabricating or shaping a probe tip as described above to form a shaped or radiused wedge probe 60. The shaped wedge probe 60 has a tip apex 62 which is reduced in length L and width W and ends 62*a* of the shaped wedge probe 60 are more radiused than the ends 52*a* of the conventional wedge probe 50. Referring to FIGS. 9 and 10, test data demonstrates the variation of tip length L and tip width W as a function of number of touchdowns, showing that both the tip length L and the tip width W are substantially reduced by a few thousand touchdowns. In accordance with the test data in this exemplary embodiment of the present invention, the predetermined number of touchdowns is preferably in the range of about 3,000 to about 12,000.

A shaped wedge probe 60 having a tip with a shorter length L and smaller width W is preferable over a conventional wedge probe 50. First, the smaller probe tips are better able to contact small targets. Furthermore, the sharper probe tip apex 62 is better able to scratch the surface of targets and develop proper electrical contacts. Still further, the radiused ends 62*a* have less propensity to accumulate debris than do the conventional wedge probe ends 52*a*.

With reference now to FIGS. 11–15, the method of fabricating a probe tip can be applied to other types of conventional probes, such as a flat probe 70 having a squared-off, blunt nose 72. FIGS. 12–15 illustrate how the blunt nose 72 is transformed into a bullet-shape after approximately 5,000; 10,000; 15,000; and 20,000 touchdown cycles in the MAAP 100, respectively. In applying the method of fabricating a probe tip to the flat probe 70, in this exemplary embodiment of the present invention the predetermined number of cycles is preferably in the range of about 15,000 to about 20,000. The MAAP 100 used in processing of the flat probe 70 illustrated in FIGS. 11–15 was provided with 45 micron abrasive particles.

Figure 16:
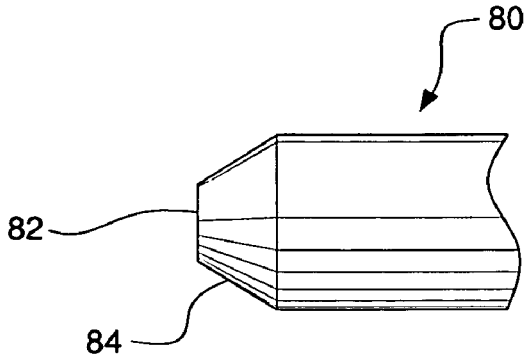
FIG. 16 is a side view of an unfinished tip of a pointed probe element having a chamfered tip.
Figure 17:
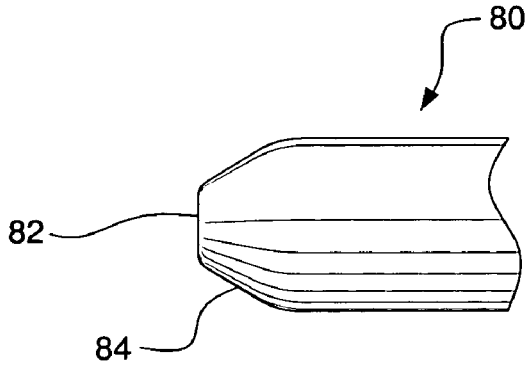
FIG. 17 is a side view of the probe element of FIG. 16, shown after undergoing 5,000 touchdown cycles in a multi-layer adhesive and abrasive pad having abrasive particles with an average size of about 25 microns in accordance with an exemplary embodiment of the present invention.
Figure 18:
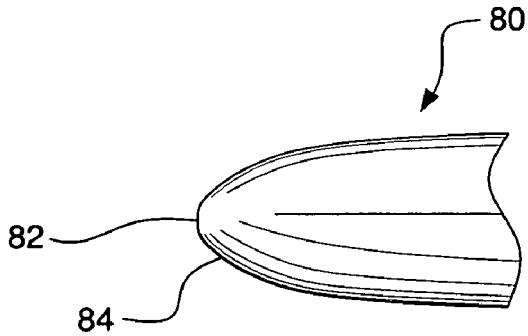
FIG. 18 is a side view of the probe element of FIG. 16, shown after undergoing 10,000 touchdown cycles in the multi-layer adhesive and abrasive pad having abrasive particles with an average size of about 25 microns in accordance with an exemplary embodiment of the present invention.

With reference now to FIGS. 16–18, the method of fabricating a probe tip can also be applied to a conventional pointed probe 80 (e.g., cone shaped) having a generally flat face 82 and a chamfered tip edge 84. FIGS. 16–18 illustrate how the flat face 82 and chamfered edge 84 are transformed into a bullet-shape after 5,000 and 10,000 touchdown cycles, respectively, using a MAAP 100 having 25 micron abrasive particles. In applying the method of probe tip fabrication to the pointed probe 80, the predetermined number of cycles is preferably in the range of about 5,000 to about 10,000.

In a second method of using the MAAP 100, the MAAP 100 may be used to maintain a desired shape of a tip 12 of a probe element 10 used in a probe card assembly. The method of maintaining a desired shape comprises a step of providing a probe element having a tip portion worn from usage to a non-optimal shape. A multi-layered adhesive and abrasive particle pad 100 is provided, and the probe tip 12 is repeatedly inserted into the pad to a predetermined and/or desired depth and removed from the pad 100 for a predetermined number of touchdown cycles. Preferably, the process of repeatedly inserting and removing the probe tip 12 is performed "on-line." That is, the step is carried out with the probe element 10 operatively integrated with a semiconductor testing apparatus. If the method of maintaining the probe tip shape is performed on-line, without removing the probe element 10 from the testing apparatus, downtime of the testing apparatus otherwise associated with removal and re-installation of the probes 10 is eliminated.

In yet a third method of using the MAAP 100, the MAAP 100 may be used to clean a tip 12 of a probe element 10 used in a probe card assembly. The method of cleaning includes steps of providing a probe element having a tip portion, for example, with debris accumulated from usage; providing a multi-layered adhesive and abrasive particle pad; and inserting the probe tip into the pad to a predetermined depth and removing the probe tip from the pad for a predetermined number of cycles. As in the method of maintaining a desired shape of the probe tip, preferably the step of repeatedly inserting and removing the probe tip 12 in the method of cleaning is performed on-line, with the probe element 10 operatively integrated with a semiconductor testing apparatus. The method of using the MAAP 100 to clean probe tips 12 is particularly efficient, as it does not typically require other processing steps such as brushing or blowing off particles, or the use of any solvents to dissolve particles.

Probe tips 12 typically require cleaning or re-shaping at varying intervals, generally after a specified number of wafer tests. The intervals differ due to the type of probe material, the material used on the connection terminals 20, the degree of overdrive, or other factors. For example, a probe tip 12 might require cleaning after as few as 1,000 test cycles, or as many as 10,000, depending upon the pertinent factors. Similarly, an exemplary probe tip 12 might require reshaping after as few as 50,000 test cycles or as many as 200,000 test cycles.

The number of touchdowns used to maintain the desired shape or to clean the probe tip 12 will vary widely and is influenced by various factors, including the condition of the probe when the maintenance procedure is initiated, the probe material, the probe material hardness, the MAAP 100 grit size, and the distance by which the probe tip 12 is inserted into the MAAP 100. Generally speaking, the desired number of touchdown cycles used in the method of maintaining the desired shape may fall within a range of about 100 to about 3,000, while the desired number of touchdown cycles used in the method of cleaning may be less than about 200.

The MAAP 100 has a further advantage of allowing probes to be inserted with a relatively low amount of force compared to prior art probe tip conditioners. Using less force reduces the risk of bending or breaking the probe needles and is beneficial to the probe tip life by reducing the repetitive high stress on probe tip 12.

It has been noted through tests that the symmetry of the probe tip is improved and is desirable over that of probe tips created by other methods, including probe tips machined by laser. The probe tips are sharper, clean, and polished. Furthermore, use of the MAAP 100 has been found to improve the planarity of the probe tips by removing burrs and accurately shaping the probe tips 12. Longer probe tips 12 come into contact with more abrasive particles than shorter probe tips, and thus the longer probe tips are shaped more aggressively and rapidly than the shorter probe tips, bringing the longer probe tips further into planarity with the other tips.

Although the present invention has been described primarily with respect to shaping, maintaining the shape of, and cleaning a tip portion of a probe element using a multi-layered adhesive and abrasive particle pad, it is not limited thereto. For example, various exemplary embodiments of the present invention utilize different pads for achieving the desired result.

Further, a variety of other modifications to the embodiments will be apparent to those skilled in the art from the disclosure provided herein. Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A method of shaping a tip portion of a probe element configured for use in a probe card assembly, the method comprising:

inserting the tip portion of the probe element into a pad to a specified depth and removing the tip portion of the probe element from the pad, the inserting and removing of the probe element being performed for a specified number of cycles, wherein the pad includes a plurality of layers that includes at least an adhesive layer and two abrasive layers that have different abrasive properties.

2. The method of claim 1, further comprising indexing the tip portion of the probe element relative to the pad by a specified distance between two of the cycles.

3. The method of claim 2, wherein the indexing includes indexing the tip portion relative to the pad by a specified distance of about 0.003 inch.

4. The method of claim 1, wherein the inserting of the tip portion of the probe element into the pad includes inserting the tip portion of the probe element into the pad to a depth in a range of about 0.010 inch to about 0.012 inch.

5. The method of claim 1, wherein the tip portion of the probe element is a squared off tip portion.

6. The method of claim 5, wherein the specified number of cycles is in a range of about 15,000 to about 20,000 cycles.

7. The method of claim 1, wherein the tip portion of the probe element is a chamfered tip portion.

8. The method of claim 7, wherein the specified number of cycles is in a range of about 5,000 to about 10,000 cycles.

9. The method of claim 1, wherein the tip portion of the probe element is a wedge-shaped tip portion.

10. The method of claim 9, wherein the specified number of cycles is in a range of about 3,000 to about 12,000 cycles.

11. The method of claim 1, wherein the two abrasive layers have different thicknesses.

12. The method of claim 1, wherein the two abrasive layers have different hardness properties.

13. The method of claim 1, wherein a first of the two abrasive layers includes abrasive particles in a first range of diameter and a second of the two abrasive layers includes abrasive particles in a second range of diameter different from the first range of diameter.

14. A method of maintaining a desired shape of a tip portion of a probe element configured for use in a probe card assembly, the method comprising:

inserting the tip portion of the probe element into a pad to a specified depth and removing the tip portion of the probe element from the pad, the inserting and removing of the probe element being performed for a specified number of cycles, wherein the pad includes a plurality of layers that includes at least an adhesive layer and two abrasive layers that have different abrasive properties.

15. The method of claim 14, wherein the inserting and removing the tip portion of the probe element are performed with the probe element integrated with a semiconductor testing apparatus.

16. The method of claim 14, wherein the two abrasive layers have different thicknesses.

17. The method of claim 14, wherein the two abrasive layers have different hardness properties.

18. The method of claim 14, wherein the a first of the two abrasive layers includes abrasive particles in a first range of diameter and a second of the two abrasive layers includes abrasive particles in a second range of diameter different from the first range of diameter.

19. A method of cleaning a tip portion of a probe element configured for use in a probe card assembly, the method comprising:

inserting the tip portion of the probe element into the pad to a specified depth and removing the tip portion of the probe element from the pad, the inserting and removing of the probe element being performed for a specified number of cycles, wherein the pad includes a plurality of layers that includes at least an adhesive layer and two abrasive layers that have different abrasive properties.

20. The method of claim 19, wherein the inserting and removing the tip portion of the probe element are performed with the probe element integrated with a semiconductor testing apparatus.

21. The method of claim 19, wherein the two abrasive layers have different hardness properties.

22. The method of claim 19, wherein a first of the two abrasive layers includes abrasive particles in a first range of diameter and a second of the two abrasive layers includes abrasive particles in a second range of diameter different from the first range of diameter.

23. The method of claim 19, wherein the two abrasive layers have different thicknesses.

* * * * *